US008800894B2

(12) United States Patent
Cheng et al.

(10) Patent No.: US 8,800,894 B2
(45) Date of Patent: Aug. 12, 2014

(54) FLUIDIC OSCILLATOR

(75) Inventors: Mengfeng Cheng, Taichung (TW); Changwen Zhang, Shen Zen (CN); Weijin Huang, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 448 days.

(21) Appl. No.: 12/855,444

(22) Filed: Aug. 12, 2010

(65) Prior Publication Data

US 2012/0037731 A1 Feb. 16, 2012

(51) Int. Cl.

| | |
|---|---|
| ***B05B 1/04*** | (2006.01) |
| ***B05B 1/08*** | (2006.01) |
| ***F15C 1/22*** | (2006.01) |
| ***F15B 21/12*** | (2006.01) |
| ***B05B 1/14*** | (2006.01) |

(52) U.S. Cl.

CPC ... *B05B 1/08* (2013.01); *F15C 1/22* (2013.01); *F15B 21/12* (2013.01); *B05B 1/14* (2013.01)

USPC ..... 239/589.1; 239/255; 239/242

(58) Field of Classification Search

CPC ..... B05B 1/14; F15B 21/12; F15B 1/22

USPC ..... 239/589.1, 242, 255; 137/811

See application file for complete search history.

(56) References Cited

U.S. PATENT DOCUMENTS

| | | | | |
|---|---|---|---|---|
| 3,233,621 | A * | 2/1966 | Manion | 137/811 |
| 3,719,195 | A * | 3/1973 | Matsuda | 137/811 |
| 4,052,002 | A * | 10/1977 | Stouffer et al. | 239/4 |

* cited by examiner

*Primary Examiner* — Len Tran
*Assistant Examiner* — Viet Le

(57) ABSTRACT

A fluidic oscillator contains at least one channel including an interacting cavity disposed therein, a first inlet communicating with the interacting cavity to flow fluid inward, and a first outlet communicating with the interacting cavity to spray the fluid flowing through the interacting cavity outward, characterized in that: at least one turbulent flow passage is used to guide the fluid to flow into the interacting cavities from one of two opposite first longitudinal walls of the interacting cavities so that a turbulent flow effect is generated in the interacting cavities, and then the fluid flows out of the first outlets to generate oscillatory spray.

5 Claims, 15 Drawing Sheets

FLUIDIC OSCILLATOR

BACKGROUND OF THE INVENTION

1. Field of the Invention

The present invention relates to a fluidic oscillator.

2. Description of the Prior Art

A conventional fluidic oscillator disclosed in U.S. Pat. No. 4,151,955 includes an interacting cavity or oscillating cavity, and the interacting cavity includes an inlet, an outlet, and a triangle stopping member located at the interacting cavity, wherein the stopping member is used to form a vortex street so that when fluid flows into the interacting cavity, the vortex street causes a flow change alternately and the fluid further flows out of the outlet, thus generating oscillatory spray fluid.

However, the oscillatory spray fluid is determined by the size and shape of the inlet, the outlet relative to the stopping member, a spaced space between the stopping member and the outlet, a range of the outlet, and a Reynolds number so that the fluid flows or sprays in different modes.

Therefore, when the number, shape, and position of the stopping member are changed, different vortex streets or flow paths occur to obtain various flowing modes and spraying function.

Another conventional fluidic oscillator disclosed in U.S. Pat. No. 4,151,955 includes two stopping members disposed in a cavity to form an interacting zone between the two stopping members and two control channels on outer sides of the two stopping members individually, and a size-decreased power nozzle is fixed in the inlet to accelerate the fluid to flow into the cavity.

Thereby, above-mentioned fluidic oscillators are widely used in many products, such as various spraying devices and cleaning devices of a shower, faucet, sprinkling truck, windshield glass, and head light. For example, a multiple spray device disclosed in U.S. Pat. No. 7,014,131 is applied to clean a windshield glass of an automotive, and enclosures for fluidic oscillators disclosed in WO2007/044354 is applicable for a shower head.

Nevertheless, after the fluidic oscillator is decreased ⅓ to ⅔ of size to meet with miniaturization demand, the flow amount of the fluid is lowered. For example, after the fluidic oscillator is decreased ⅓ of size, its flow amount is diminished to lower power, so that a swirl effect can not be created to have normal oscillatory spray fluid.

The present invention has arisen to mitigate and/or obviate the afore-described disadvantages.

SUMMARY OF THE INVENTION

The primary object of the present invention is to provide a fluidic oscillator that is capable of overcoming the shortcomings of the conventional fluidic oscillator.

Further object of the present invention is to provide a fluidic oscillator of which at least one turbulent flow passage of the fluidic oscillator allows to guide the fluid to flow into at least one interacting cavity of the channel so that the fluid interacts with another flows which flows into the interacting cavity form the first inlet to generate a swirl effect, such that even though a size of the fluidic oscillator is decreased ⅓ to ⅔ times smaller than a conventional size of the fluidic oscillator, the size-decreased fluidic oscillator still allows to generate oscillatory spray fluid.

Another object of the present invention is to provide a fluidic oscillator that is capable of generating horizontally and vertically oscillatory spray fluid, accordingly a three-dimensional fluid spray is viewed outside the fluidic oscillator.

To obtain the above objectives, a fluidic oscillator provided by the present invention contains:

at least one channel including an interacting cavity disposed therein, a first inlet communicating with the interacting cavity to flow fluid inward, and a first outlet communicating with the interacting cavity to spray the fluid flowing through the interacting cavity outward, characterized in that: at least one turbulent flow passage is used to guide the fluid to flow into the interacting cavities from one of two opposite first longitudinal walls of the interacting cavities so that a turbulent flow effect is generated in the interacting cavities, and then the fluid flows out of the first outlets to generate oscillatory spray;

wherein the fluidic oscillator includes two channels disposed vertically thereon, and two turbulent flow passages arranged on two second longitudinal walls of outer sides of the channels respectively, each turbulent flow passage includes the second inlet fixed therein to flow the fluid inward, and includes one second outlet to guide the fluid in the turbulent flow passage to the first outlet of the interacting cavity of the channel;

the fluidic oscillator further comprises a turbulent flow controlling device to adjustably control a flow amount of the fluid which flows into the interacting cavity through the turbulent flow passage;

wherein the fluidic oscillator includes one channel, and the turbulent flow passage is fixed in a second longitudinal wall of the channel; the turbulent flow passage includes the second inlet fixed therein to flow the fluid inward, and includes one second outlet to guide the fluid in the turbulent flow passage to the first outlet of the interacting cavity of the channel individually;

wherein the interacting cavity is defined between middle sections of two symmetrical stopping members attached on the first outlet, and each stopping member includes one control passageway disposed on an outer side thereof.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
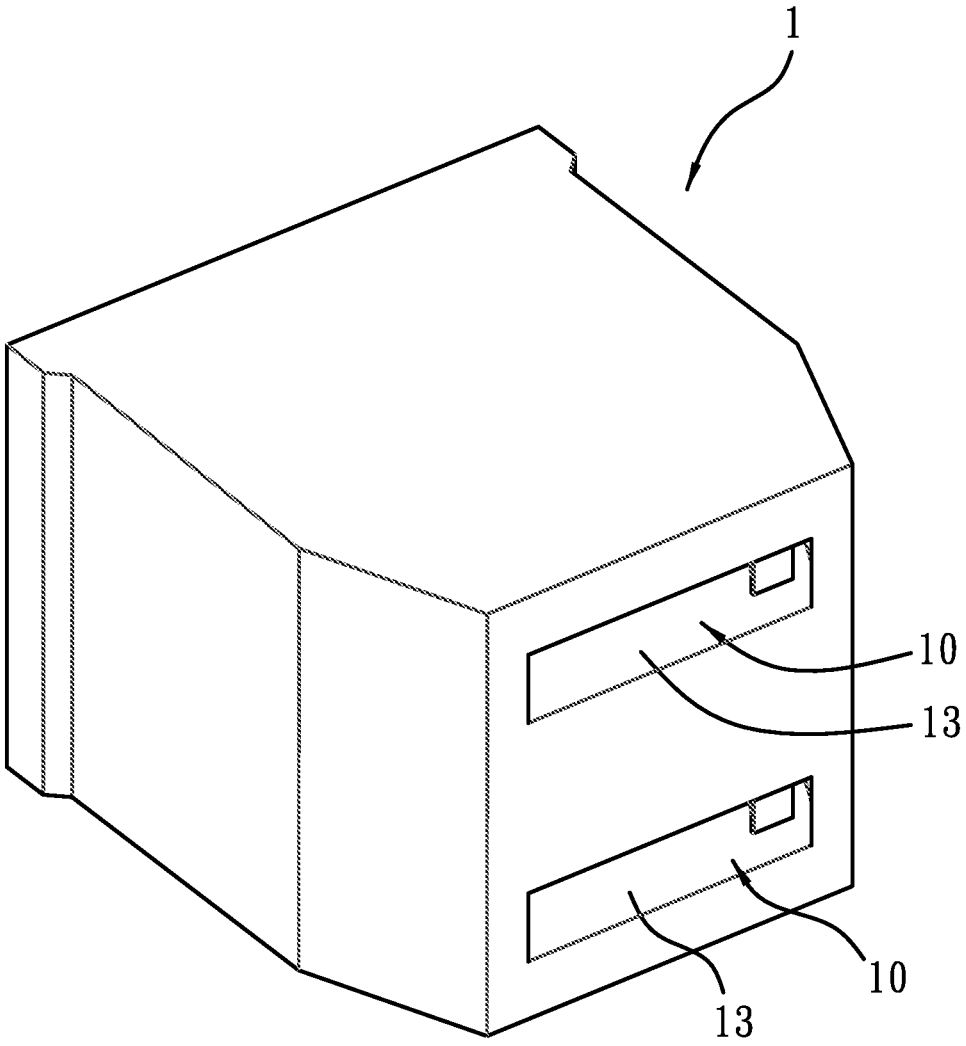
FIG. 1 is a perspective view showing the assembly of a fluidic oscillator according to a first embodiment of the present invention.
Figure 2:
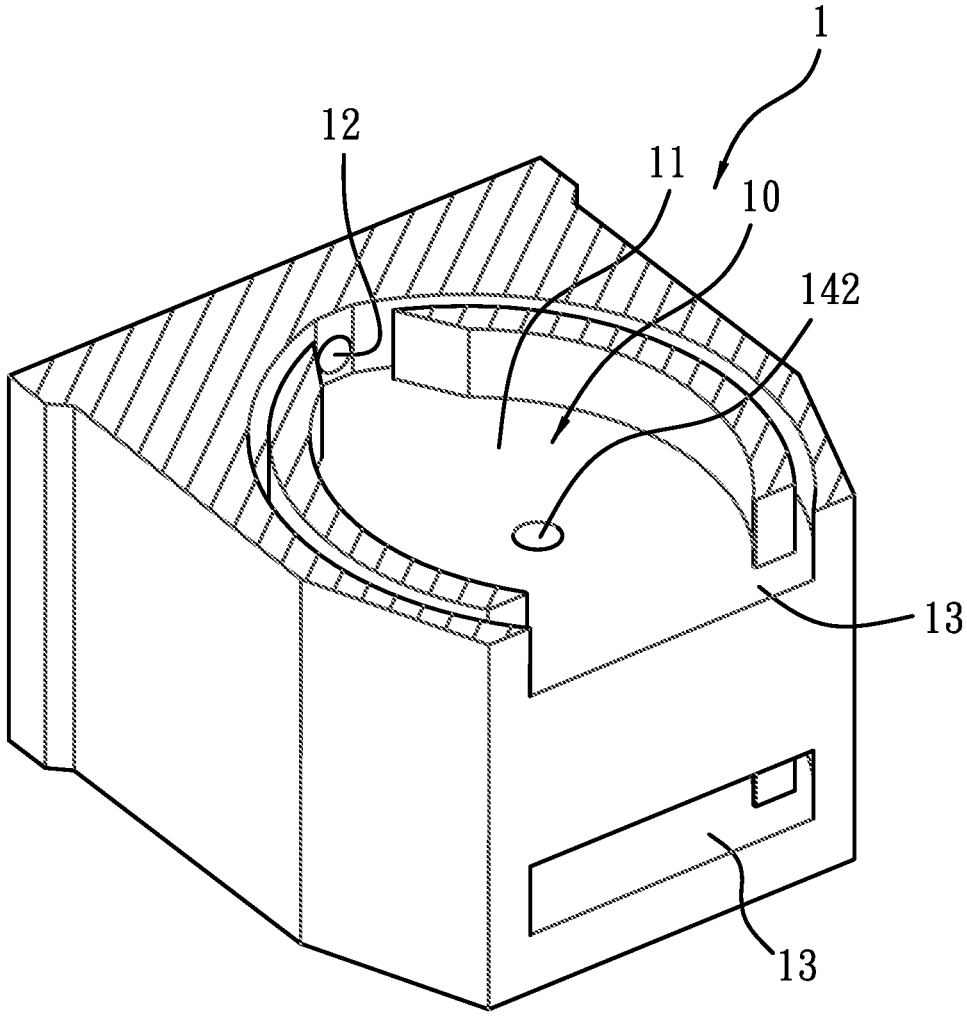
FIG. 2 is a cross-sectional perspective view showing the assembly of the fluidic oscillator according to the first embodiment of the present invention.
Figure 3:
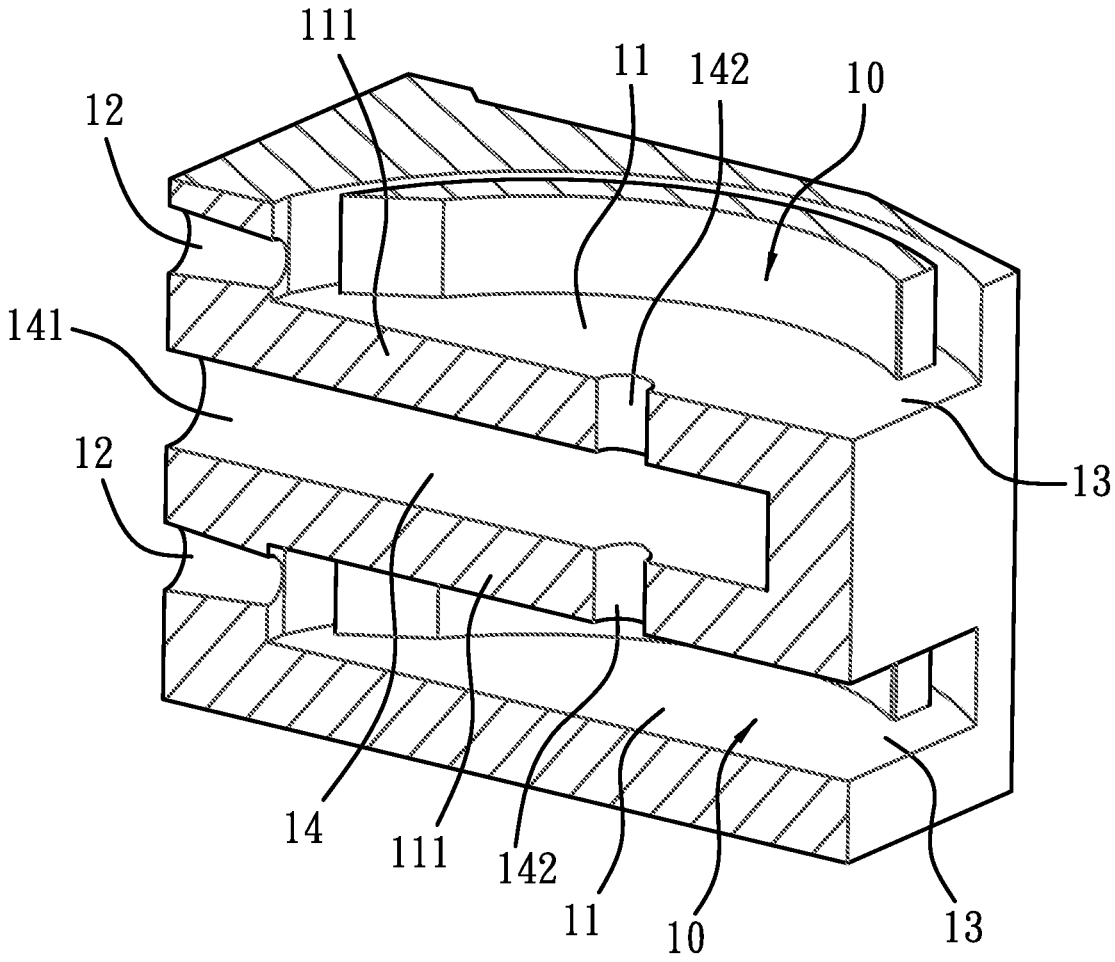
FIG. 3 is another cross-sectional perspective view showing the assembly of the fluidic oscillator according to the first embodiment of the present invention.

Referring to FIGS. 1-3, a fluidic oscillator 1 according to a first embodiment of the present invention comprises two channels 10 disposed on a vertical upper and a vertical lower portions thereof respectively and being symmetrical to each other, each channel 10 includes an interacting cavity 11, a first inlet 12 communicating with the interacting cavity 11 to flow fluid inward, and a first outlet 13 communicating with the interacting cavity 11 to spray the fluid flowing through the interacting cavity 11 outward. An improvement of the fluidic oscillator 1 of the first embodiment is described as follows.

A turbulent flow passage 14 is mounted in a first longitudinal wall 111 between the interacting cavities 11, and includes a second inlet 141 fixed therein to flow the fluid inward, and includes two second outlets 142 to guide the fluid in the turbulent flow passage 14 to the interacting cavities 11 of the two channels 10 individually. In this embodiment, the turbulent flow passage 14 includes a tunnel segment axially extending therealong and two vertical holes communicating with the tunnel segment, the second inlet 141 is formed in the tunnel segment, and the second outlets 142 are arranged on connections of the vertical holes and the interacting cavities 11, wherein the second outlets 142 are located at middle portions of the interacting cavities 11 individually.

Figure 4:
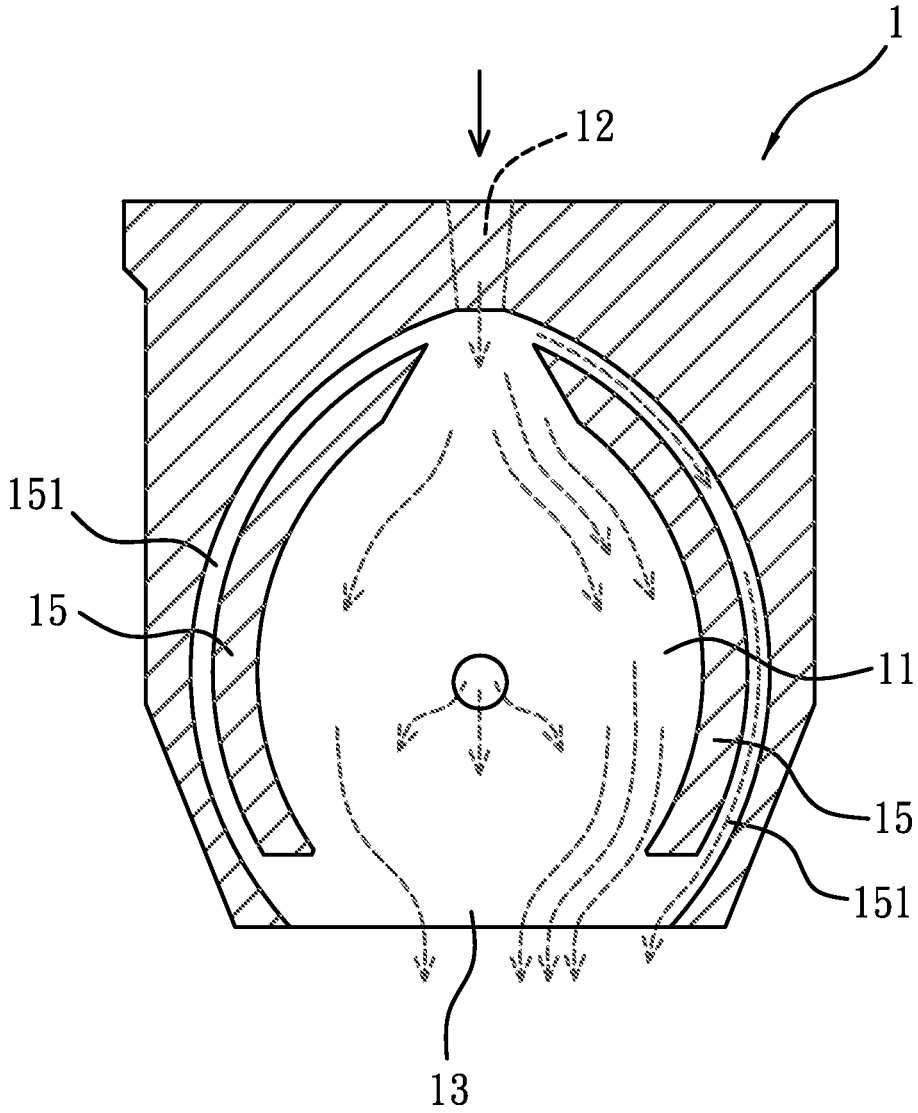
FIG. 4 is a cross sectional view showing the operation of the fluidic oscillator according to the first embodiment of the present invention.
Figure 5:
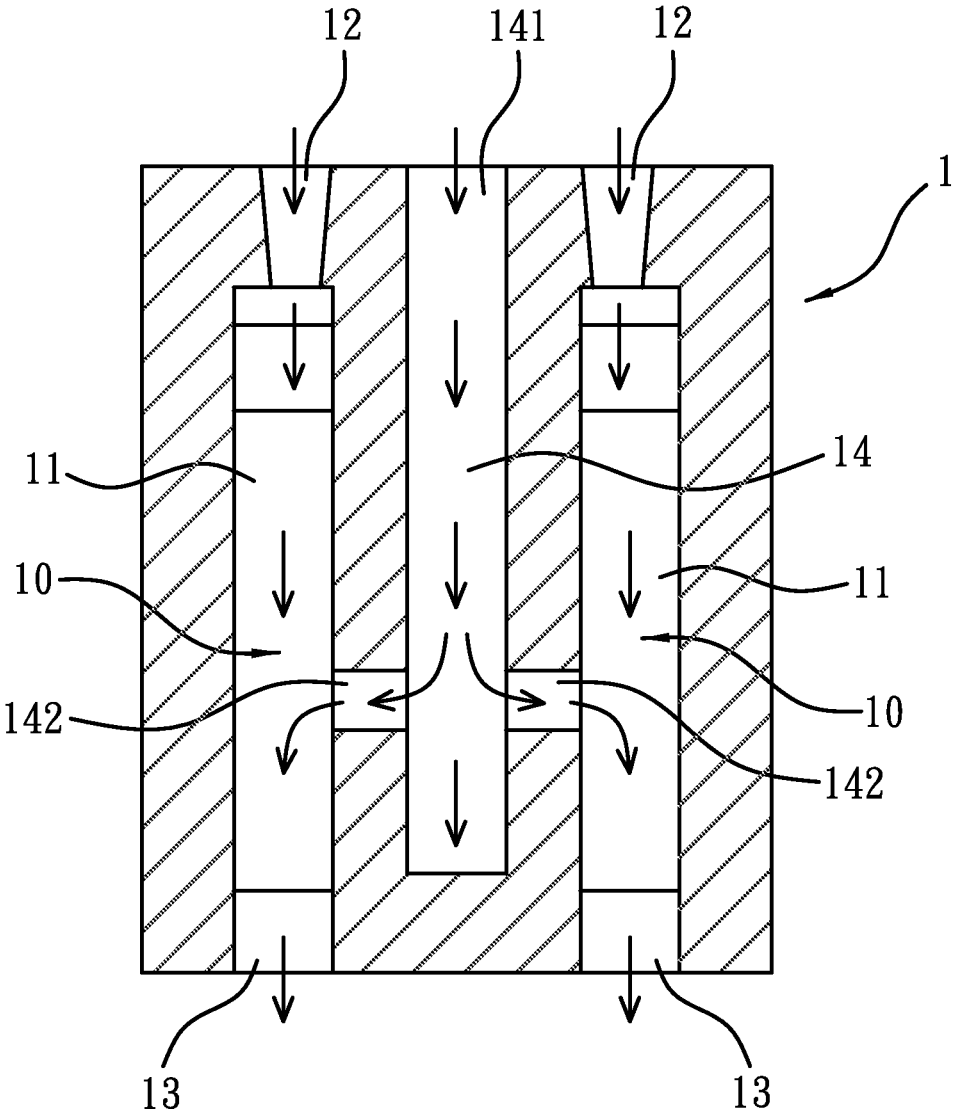
FIG. 5 is another cross sectional view showing the operation of the fluidic oscillator according to the first embodiment of the present invention.

The turbulent flow passage 14 is used to guide the fluid to flow into the interacting cavities 11 as shown in FIGS. 4 and 5 so that the fluid further interacts with another fluid flowing into the interacting cavities 11 from the first inlets 12 of the channels 10 to generate a turbulent flow effect, hence the fluid flowing out of the first outlets 13 generates circular and oscillatory spray.

The interacting cavity 11 of the channel 10 is defined between middle sections of two symmetrical stopping members 15 attached on the first outlet 13, and each stopping member 15 includes one control passageway 151 disposed on an outer side thereof. Due to the stopping member 15 is well-known prior art, further remarks are omitted.

Figure 6:
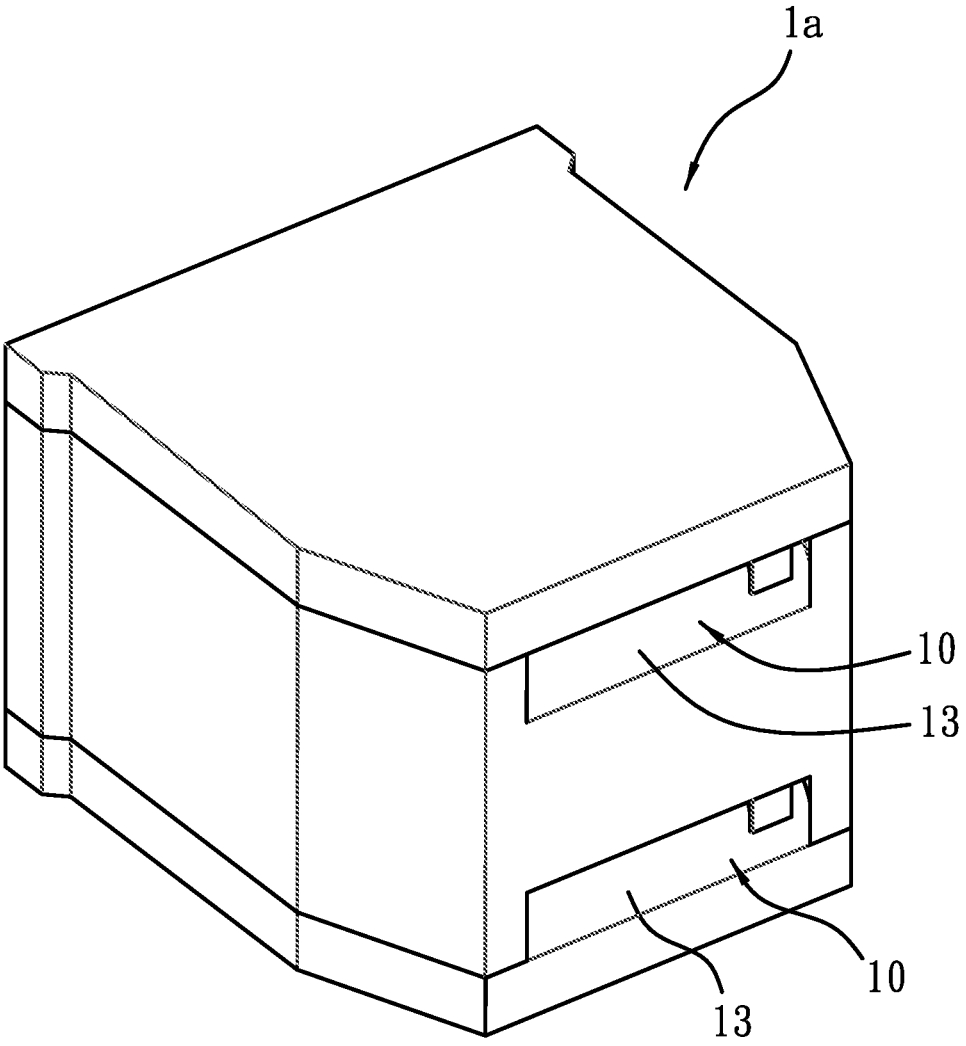
FIG. 6 is a perspective view showing the assembly of a fluidic oscillator according to a second embodiment of the present invention.
Figure 7:
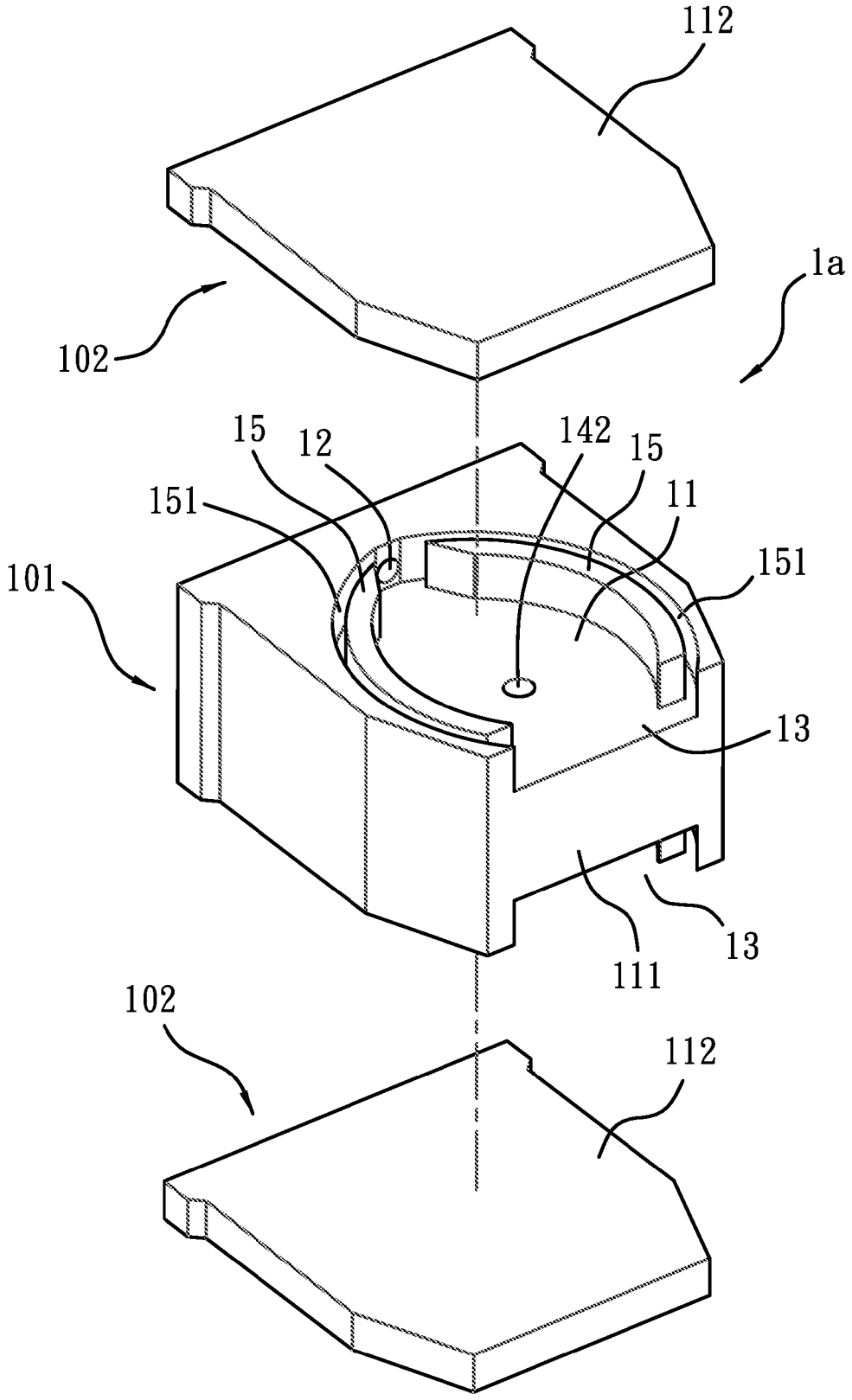
FIG. 7 is a perspective view showing the exploded components of the fluidic oscillator according to the second embodiment of the present invention.

With reference to FIGS. 6 and 7, a difference of a fluidic oscillator 1*a* of a second embodiment of the present invention from that of the first embodiment comprises a first body 101 and two covers 102, wherein the first body 101 is applied to form a main part of the fluidic oscillator 1*a*, and the two covers 102 are connected with a vertically upper and a vertically lower ends of the first body 101, each cover 102 serves to form a second longitudinal wall 112 to be located at a longitudinally outer side of the interacting cavity 11 so as to facilitate specific working and manufacturing method.

Figure 8:
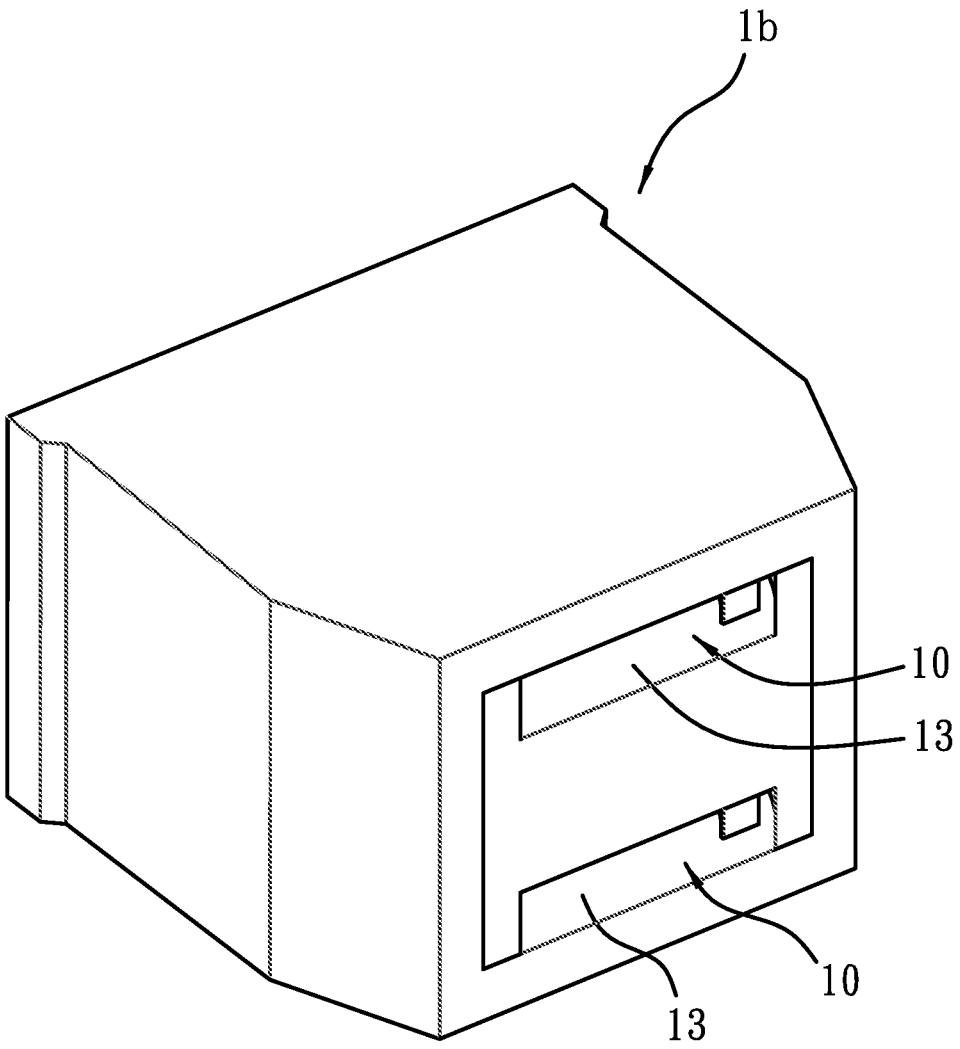
FIG. 8 is a perspective view showing the assembly of a fluidic oscillator according to a third embodiment of the present invention.
Figure 9:
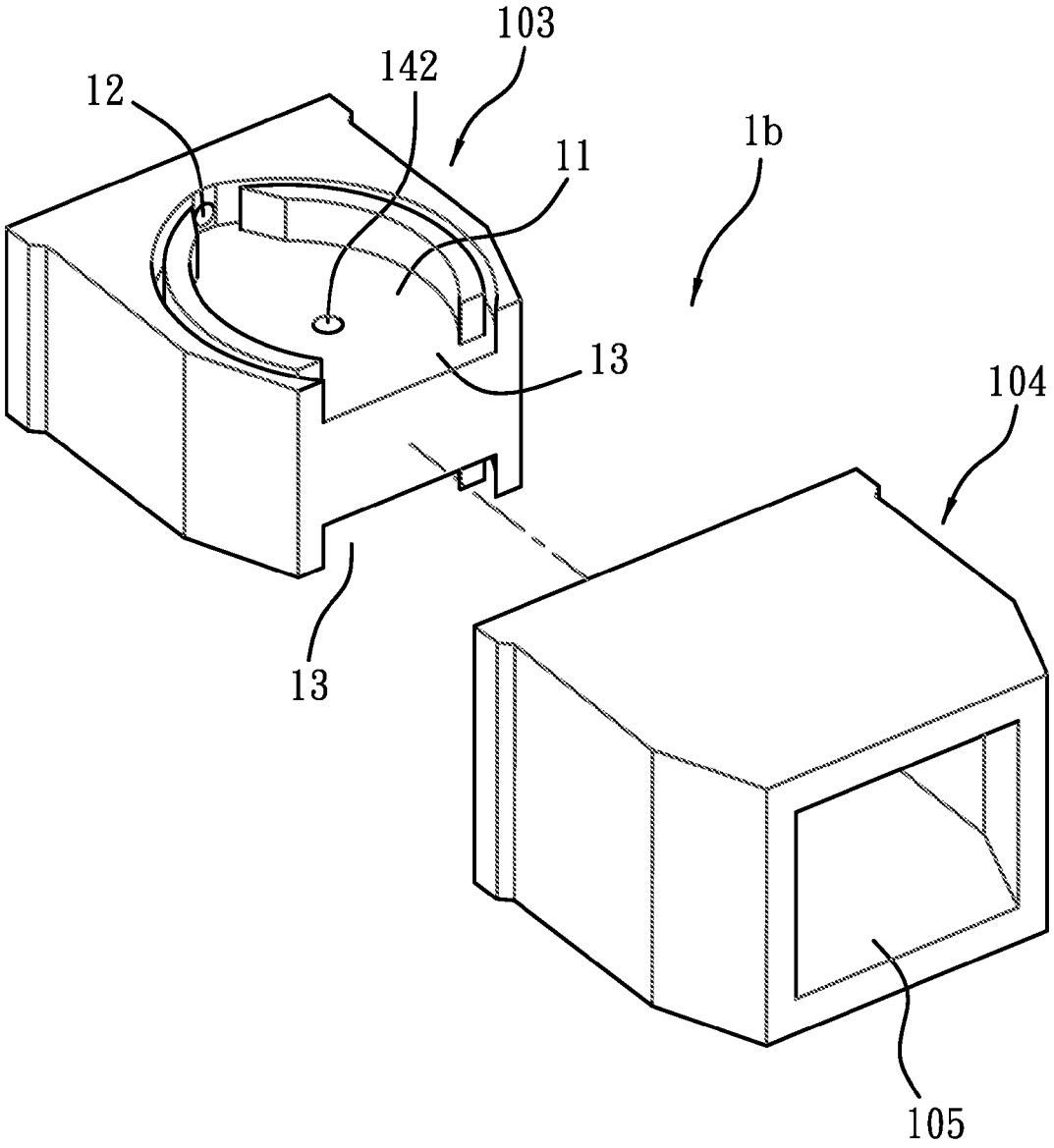
FIG. 9 is a perspective view showing the exploded components of the fluidic oscillator according to the third embodiment of the present invention.

As illustrated in FIGS. 8 and 9, a difference of a fluidic oscillator 1*b* of a third embodiment of the present invention from that of the second embodiment comprises a second body 103 and a housing 104, wherein the second body 103 is used to form a main part of the fluidic oscillator 1*b*, the housing 104 includes a groove 105 mounted therein to receive the second body 103 and serves to form a second longitudinal wall 112 located at a longitudinally outer side of the interacting cavity 11 so as to facilitate specific working and manufacturing method.

Figure 10:
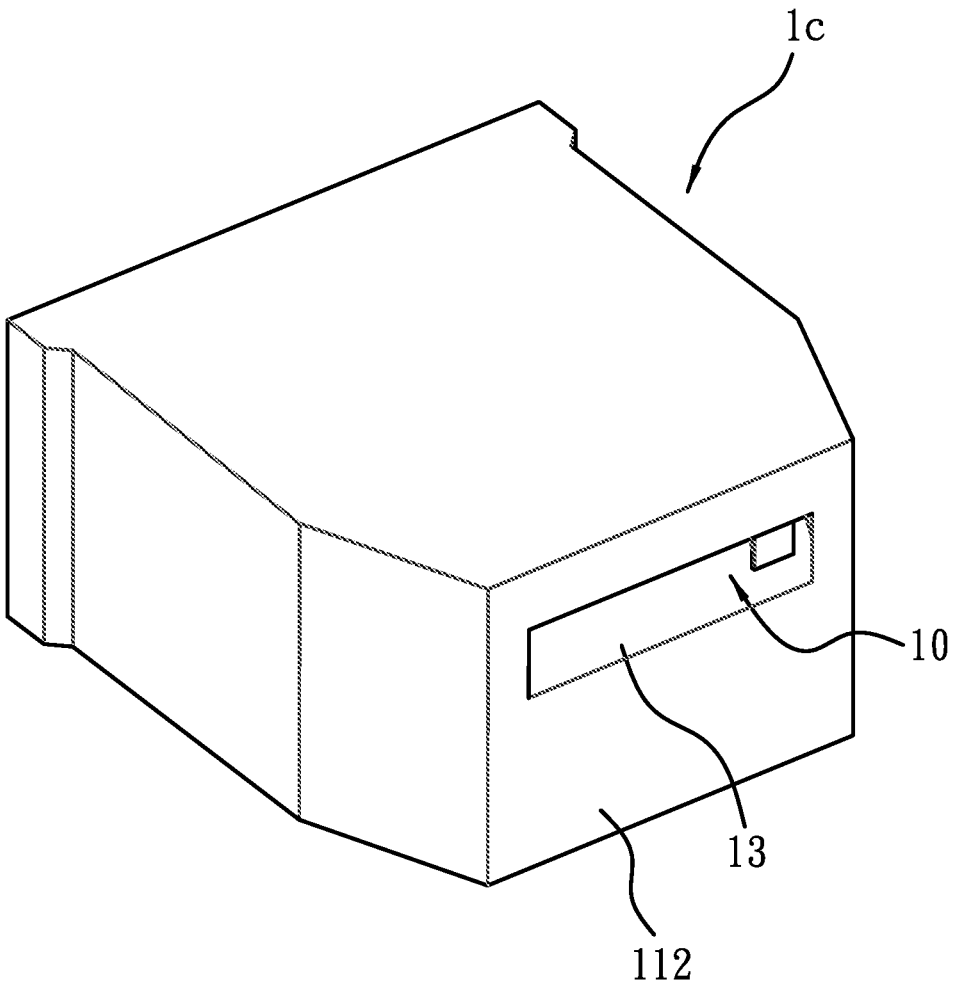
FIG. 10 is a perspective view showing the assembly of a fluidic oscillator according to a fourth embodiment of the present invention.
Figure 11:
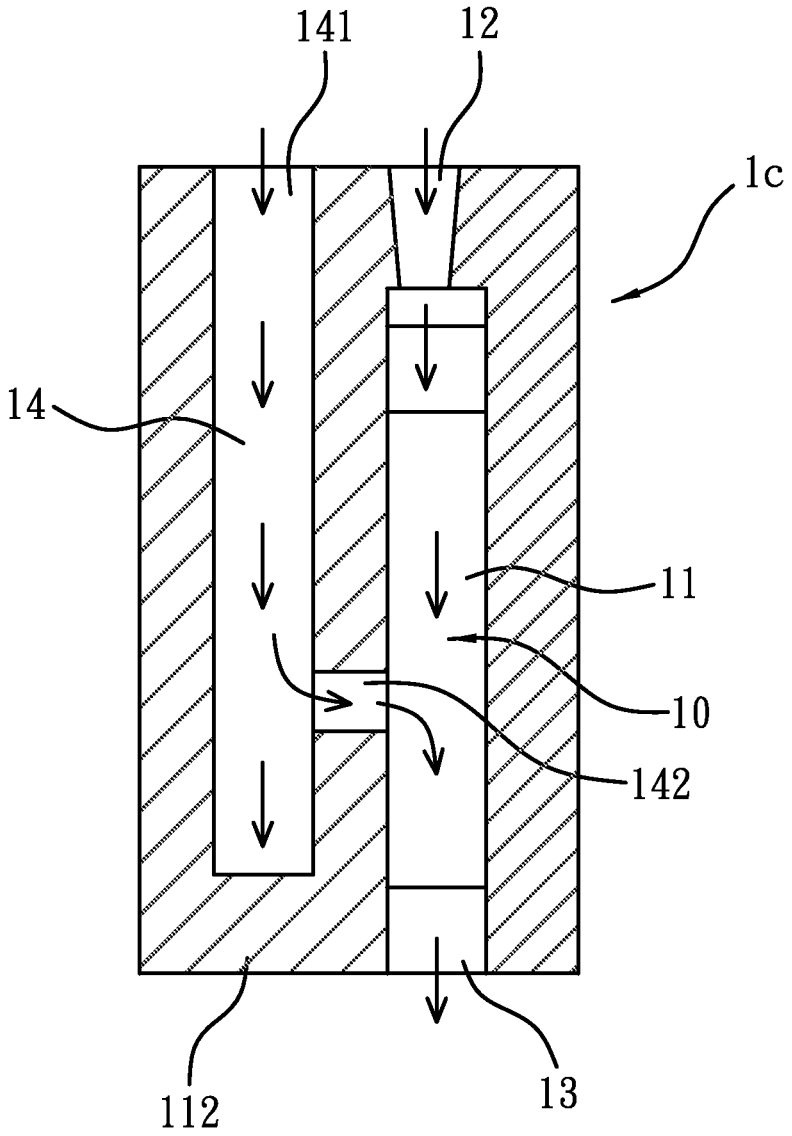
FIG. 11 is a cross sectional view showing the operation of the fluidic oscillator according to the fourth embodiment of the present invention.

With reference to FIGS. 10 and 11, a difference of a fluidic oscillator 1*c* of a fourth embodiment of the present invention from that of the first embodiment comprises one channel 10, therefore a turbulent flow passage 14 is fixed on a second longitudinal wall 112 which is located at a longitudinal bottom side of the interacting cavity 11. Of course, the turbulent flow passage 14 is capable of being fixed on another second longitudinal wall 112 which is located at a longitudinal top side of the interacting cavity 11.

Figure 12:
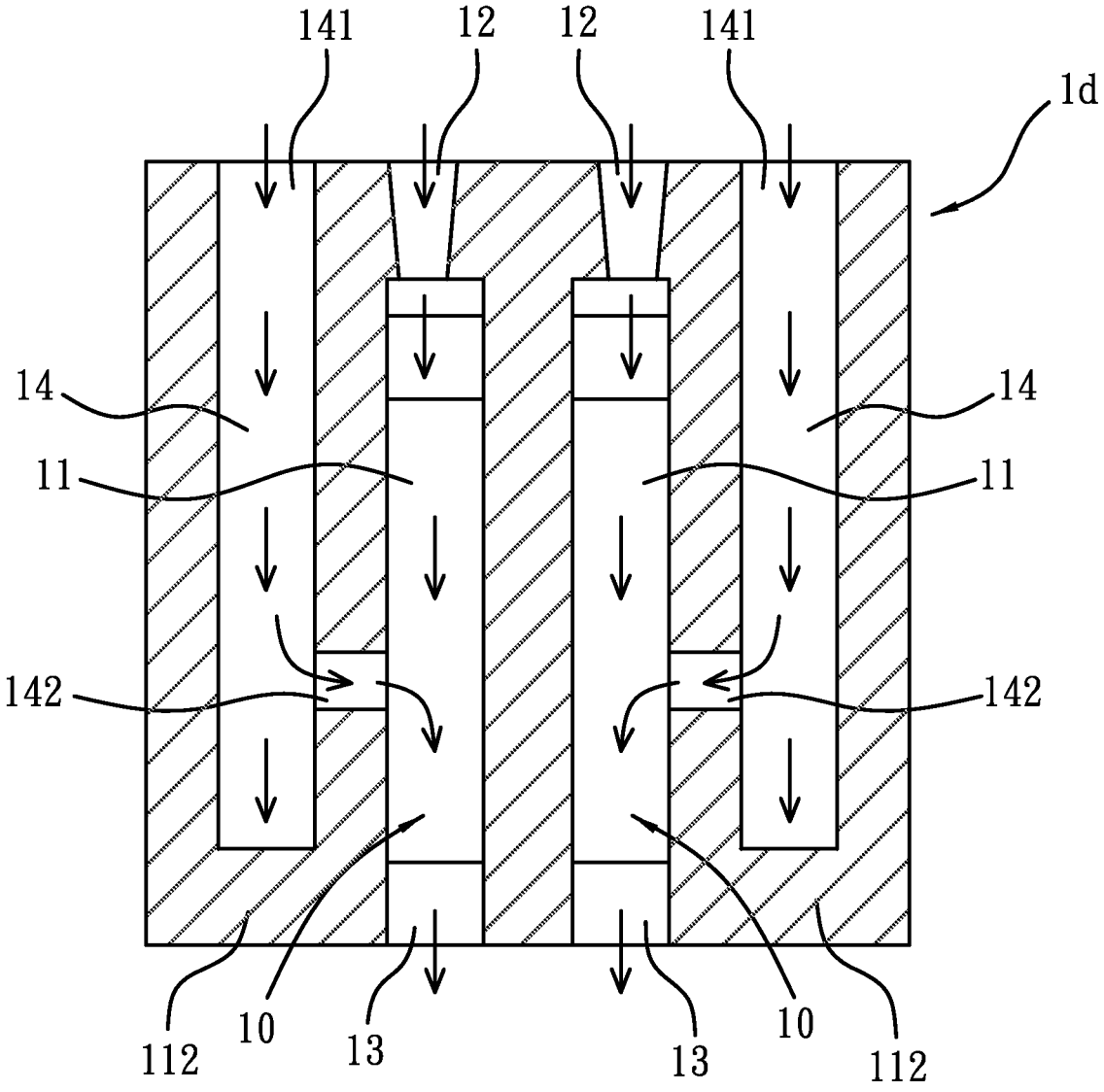
FIG. 12 is a cross sectional view showing the operation of a fluidic oscillator according to a fifth embodiment of the present invention.

Referring to FIG. 12, a difference of a fluidic oscillator 1*d* of a fifth embodiment of the present invention from that of the first embodiment comprises two channels 10, each channel 10 including one turbulent flow passage 14 arranged on a second longitudinal wall 112 of an outer side of the channel 10 so that an interacting cavity 11 of the channel 10 is provided with the turbulent flow passage 14 to generate an turbulent flow effect when fluid in the interacting cavity 11 flows through the turbulent flow passage 14.

Figure 13:
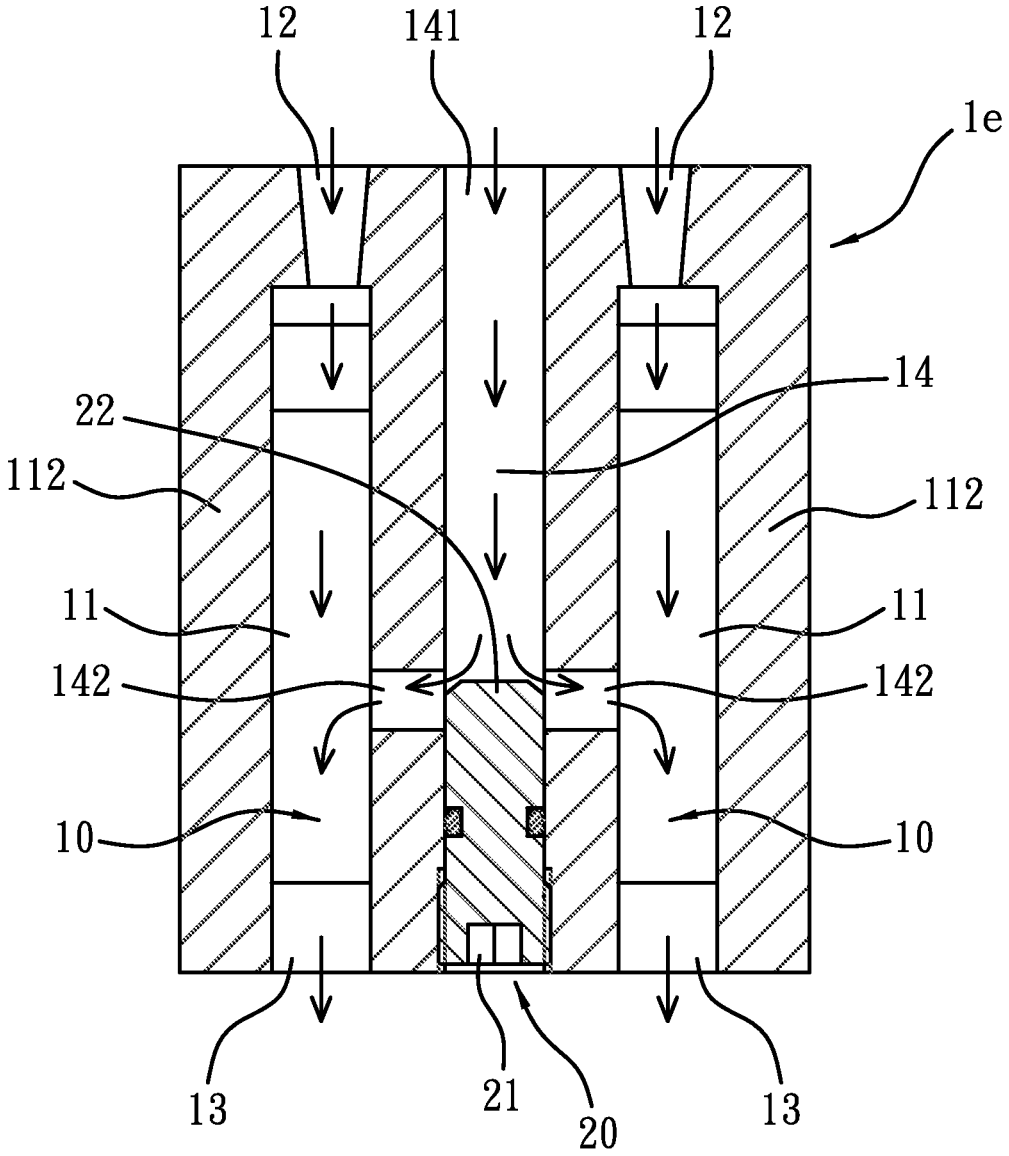
FIG. 13 is a cross sectional view showing the operation of a fluidic oscillator according to a sixth embodiment of the present invention.

Referring to FIG. 13, a difference of a fluidic oscillator 1*e* of a sixth embodiment of the present invention from that of the first embodiment comprises a turbulent flow controlling device 20 secured on an axially outer side of a turbulent flow passage 14 to control a flow amount of a fluid which flows into an interacting cavity 11 through the turbulent flow passage 14. In this embodiment, the turbulent flow controlling device 20 is a rod-shaped screwing element screwed in the fluidic oscillator 1*e*, includes a rotary adjusting portion 21 disposed on an outer side thereof, and includes a stop portion 22 mounted on an inner side thereof, the stop portion 22 allows to retract into the turbulent flow passage 14 by rotating the rotary adjusting portion 21 so that an area of a cross section in the turbulent flow passage 14 to flow the fluid is adjusted, especially for the area of the cross section in the turbulent flow passage 14 to flow the fluid which flows into two vertical holes of the turbulent flow passage 14 from an axial tunnel segment of the turbulent flow passage 14.

The turbulent flow controlling device 20 is not limited to be embodied in a screwing manner, e.g., any components allowing to adjust the flow amount of the fluid which flows into the interacting cavity 11 through the turbulent flow passage 14 is provided in this embodiment, and the turbulent flow controlling device 20 is applicable for the fluidic oscillators of above-mentioned embodiments of the present invention.

Figure 14:
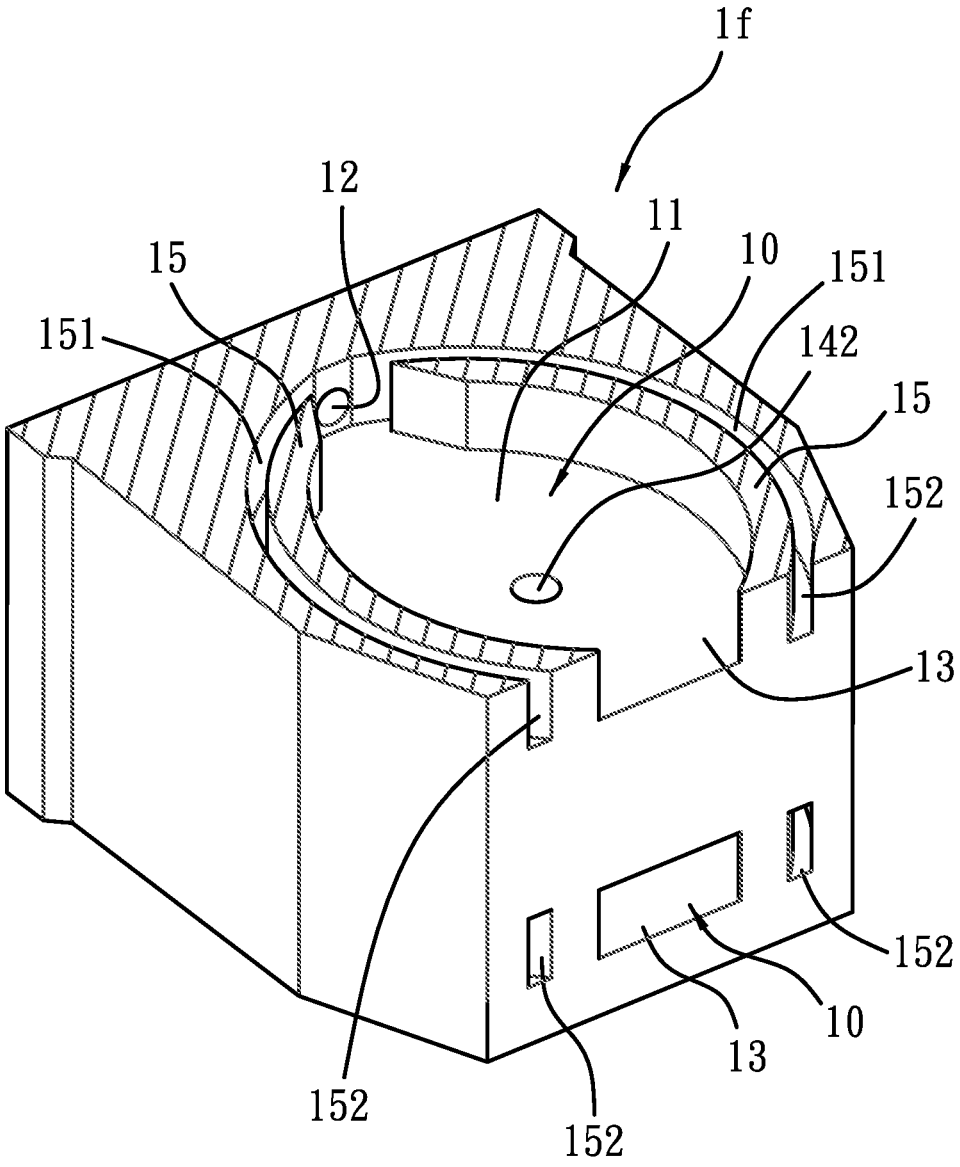
FIG. 14 is a cross-sectional perspective view showing the assembly of a fluidic oscillator according to a seventh embodiment of the present invention.
Figure 15:
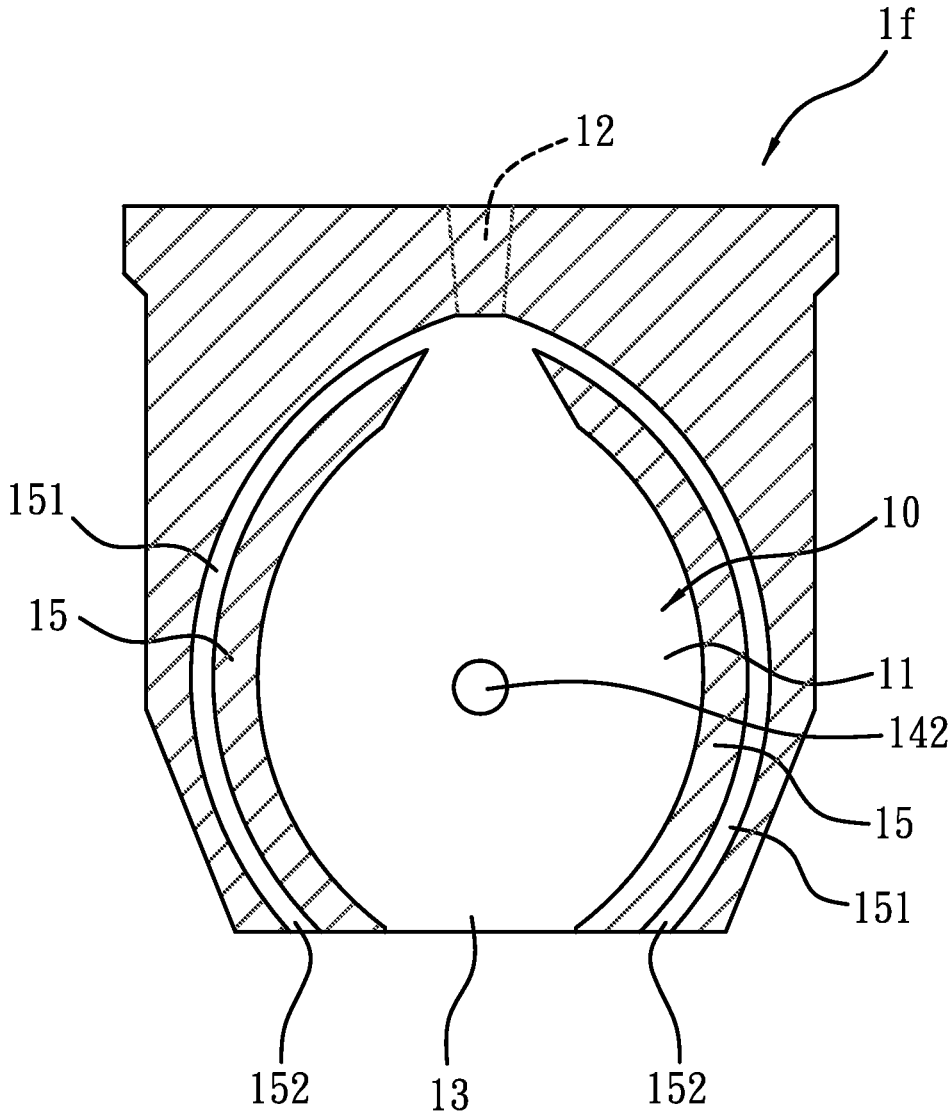
FIG. 15 is a cross sectional view showing the assembly of the fluidic oscillator according to the seventh embodiment of the present invention.

As shown in to FIGS. 14 and 15, a difference of a fluidic oscillator 1*f* of a seventh embodiment of the present invention from that of the first embodiment comprises two stopping members 15 to form an interacting cavity 11 including two axially outer edges extending toward an outermost side of the interacting cavity 11 respectively so that distal ends of two control passageways 151 fixed on outer sides of the stopping members 15 are capable of defining two third outlets 152 individually, and each third outlet 152 is spaced apart from a first outlet 13 of a channel 10 such that an oscillating range of the fluid on a middle area of the channel 10 is enhanced.

Thereby, at least one turbulent flow passage 14 of the fluidic oscillator of the present invention allows to guide the fluid to flow into at least one interacting cavity 11 of the channel 10 so that the fluid interacts with another flows which flows into the interacting cavity 11 form the first inlet 12 to generate a swirl effect, such that even though a size of the fluidic oscillator is decreased ⅓ to ⅔ times smaller than a conventional size of the fluidic oscillator, the size-decreased fluidic oscillator still allows to generate oscillatory spray fluid. For example, a diameter of the interacting cavity of the fluidic oscillator is within 5 mm to 20 mm or less than 20 mm In addition, a range of a flowing path of the fluid in the interacting cavity is within 5 mm to 20 mm or less than 20 mm.

Appendix A shows the fluidic oscillator of the first embodiment of the present invention generating horizontally and vertically oscillatory spray fluid under a test, hence a three-dimensional fluid spray is viewed outside the fluidic oscillator.

Appendix B also shows the fluidic oscillator of the first embodiment of the present invention generating the horizontally and vertically oscillatory spray fluid under the test so that the three-dimensional fluid spray is viewed outside the fluidic oscillator.

As illustrated in Appendix A and Appendix B, the fluidic oscillator 1 of the first embodiment of the present invention is tested, wherein the fluid flowing out of the first outlets 13 generates the circular and oscillatory spray and horizontally and vertically oscillatory spray fluid is formed as well, hence a three-dimensional fluid spray is viewed outside the fluidic oscillator.

Appendix C shows a turbulent flow passage of the fluidic oscillator of the first embodiment of the present invention being jammed to form a column-shape fluid spray.

Appendix D also shows the turbulent flow passage of the fluidic oscillator of the first embodiment of the present invention being jammed to form the column-shape fluid spray.

In addition, after the turbulent flow passage 14 of the fluidic oscillator 1 of the first embodiment is jammed under the test, the fluid flowing out of the first outlets 13 generates a column-shaped spray as shown in Appendix C and Appendix D but not form three-dimensional and oscillatory spray fluid spray, therefore the turbulent flow passage 14 of the fluidic oscillator 1 is provided to stop the oscillatory spray.

While we have shown and described various embodiments in accordance with the present invention, it is clear to those skilled in the art that further embodiments may be made without departing from the scope of the present invention.

What is claimed is:

1. A fluidic oscillator comprising:

at least one channel including an interacting cavity disposed therein, at least one first inlet communicating with the interacting cavity to flow fluid inward, and at least one first outlet communicating with the interacting cavity to spray the fluid flowing through the interacting cavity outward, characterized in that:

at least one turbulent flow passage is used to guide a fluid in the at least one turbulent flow passage to flow into the interacting cavity or cavities so as to interact with the fluid from the first inlet(s) from one of two opposite first longitudinal walls of the interacting cavity or cavities, such that a turbulent flow effect is generated in the interacting cavity or cavities, and then the fluid in the interacting cavity flows out of the first outlet(s) to generate oscillatory spray;

the fluidic oscillator includes one channel, and the at least one turbulent flow passage is fixed in a second longitudinal wall of the channel;

the at least one turbulent flow passage includes a second inlet fixed therein to flow the fluid inward and a second outlet to guide the fluid in the at least one turbulent flow passage to the first outlet of the interacting cavity of the channel individually;

the second outlet is located at a middle portion of the interacting cavity;

the interacting cavity or cavities are defined between middle sections of two symmetrical stopping members attached on the first outlet, and each stopping member includes one control passageway disposed on an outer side thereof;

a connection of the at least one turbulent flow passage and the interacting cavity or cavities are located at the middle portion of the interacting cavity;

a diameter of the interacting cavity of the fluidic oscillator is within 5 mm to 20 mm, and a range of a flowing path of the fluid in the interacting cavity is within 5 mm to 20 mm.

2. The fluidic oscillator as claimed in claim 1, wherein the fluidic oscillator includes two channels disposed vertically thereon, and includes one turbulent flow passage mounted in the first longitudinal wall between the interacting cavities, the turbulent flow passage includes a second inlet fixed therein to flow the fluid inward, and includes two second outlets to guide the fluid in the turbulent flow passage to the first outlets of the interacting cavities of the two channels individually.

3. The fluidic oscillator as claimed in claim 1, wherein the fluidic oscillator includes two channels disposed vertically thereon, and two turbulent flow passages arranged on two second longitudinal walls of outer sides of the channels respectively, each turbulent flow passage includes the second inlet fixed therein to flow the fluid inward, and includes one second outlet to guide the fluid in the turbulent flow passage to the first outlet of the interacting cavity of the channel.

4. The fluidic oscillator as claimed in claim 1 further comprising a turbulent flow controlling device to adjustably control a flow amount of the fluid which flows into the interacting cavity through the turbulent flow passage.

5. The fluidic oscillator as claimed in claim 4, wherein the turbulent flow controlling device is a screwing element screwed in the fluidic oscillator, and includes a rotary adjusting portion and a stop portion, the stop portion allows to retract into the turbulent flow passage by rotating the rotary adjusting portion so that an area of a cross section in the turbulent flow passage to flow the fluid is adjusted.

* * * * *